United States Patent [19]

Fleck

[11] 4,023,505

[45] May 17, 1977

[54] SHELVING UNITS

[75] Inventor: René Fleck, Hochstatt, France

[73] Assignee: Societe Anonyme dite: TIM-FLECK S.A., France

[22] Filed: Feb. 17, 1976

[21] Appl. No.: 658,577

[30] Foreign Application Priority Data

Feb. 25, 1975 France ..... 75.06499

[52] U.S. Cl. ..... 108/110; 108/111; 248/250

[51] Int. Cl.[2] ..... A47B 9/00

[58] Field of Search ..... 108/96, 101, 106, 107, 108/110, 111; 211/190, 191, 194, 208; 248/235, 250

[56] References Cited

UNITED STATES PATENTS

| | | | |
|---|---|---|---|
| 1,431,823 | 10/1922 | Leconte | 108/114 |
| 3,835,354 | 9/1974 | Torres-Pena | 108/111 X |

*Primary Examiner*—James C. Mitchell

*Attorney, Agent, or Firm*—Robert E. Burns; Emmanuel J. Lobato; Bruce L. Adams

[57] ABSTRACT

A shelving framework system for making up shelving units, desks, display units and the like for fitting out shops, stores and so on. The system uses sleeve units which can be partially telescoped into one another, and means for limiting the resulting interpenetration to form gaps between the units. Clips for the support of shelves or other accessories are attached to the sleeve units in the gaps.

7 Claims, 2 Drawing Figures

FIG.1
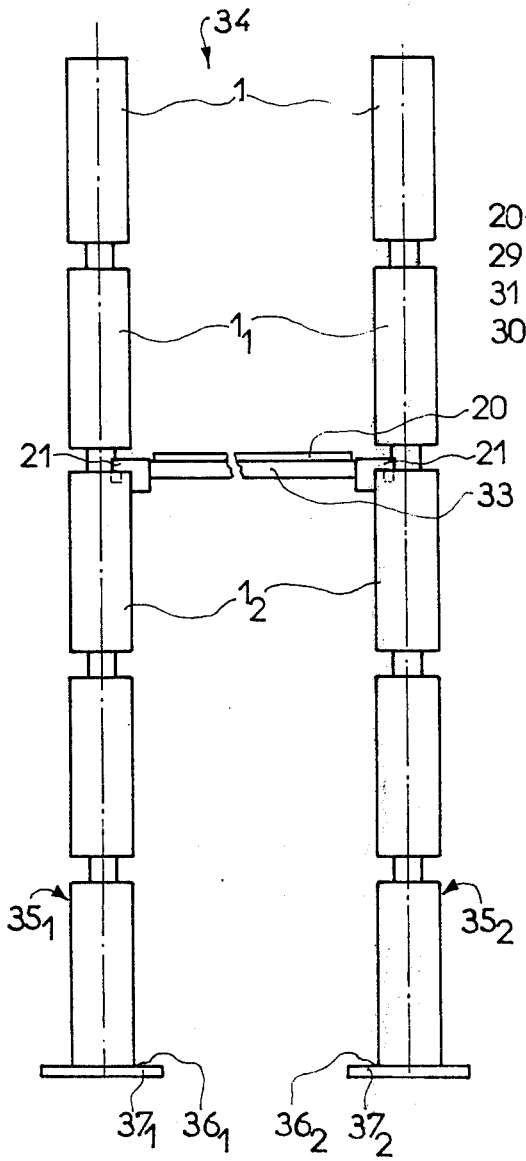
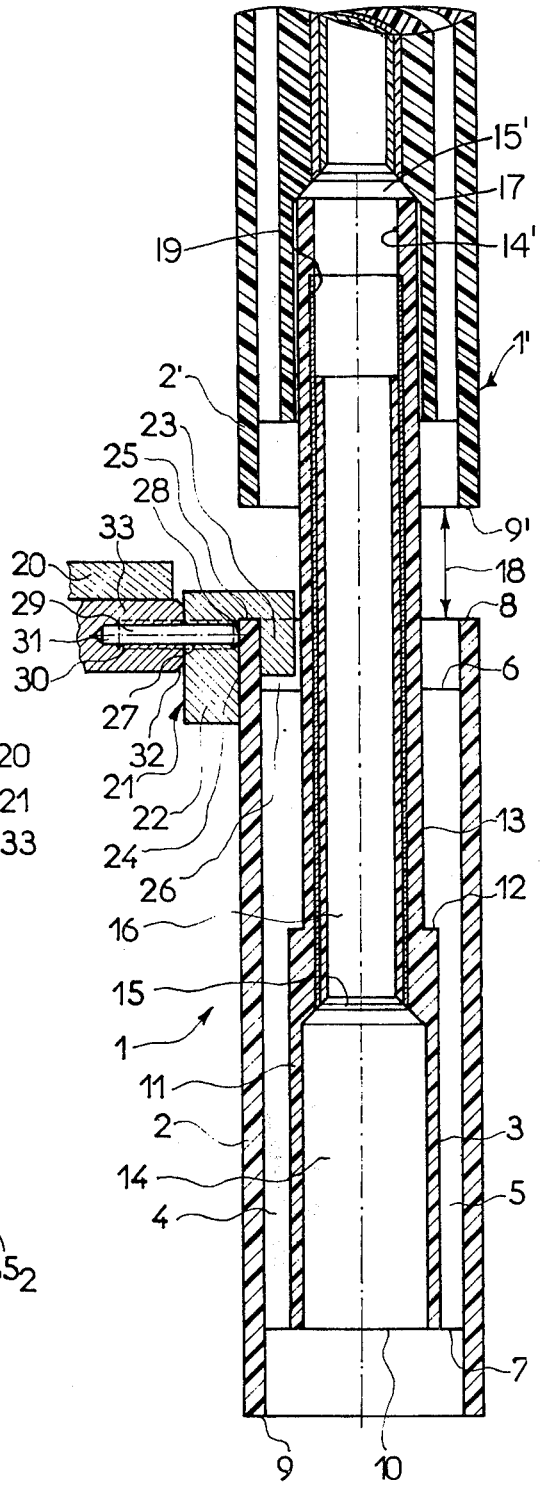
FIG. 2

SHELVING UNITS

BACKGROUND OF THE INVENTION

The invention concerns a shelving framework system for making up shelving units, desks and display units for fitting out shops, stores and the like.

One known form of framework system includes a support provided with any suitable form of base on which is disposed an upright over which is threaded a sleeve made up of several sections, with reduced diameter portions at the ends, and cross-braces threaded on back-to-back. The cross-braces have a cylindrical body complementing the uprights and a conical flared portion with the larger cross-section at the free end. The sleeve sections are provided with reduced diameter portions near their ends providing abutments for the larger ends of the conical flared portions and thus limiting the penetration of the cross-braces into the sleeve sections.

Another known form of upright has virtually the same features, namely a base at its lower end, sections making up a covering sleeve, cross-braces threaded on back-to-back, and clamping screws, but the uprights, cross-braces and sleeve sections have flat faces acting as a brake and preventing rotation in the vertical plane of the various accessories hooked onto the upper edges of the sleeve sections.

Such systems are relatively expensive, however, as a large number of basic elements are required. Also, the various elements must be carefully selected, which involves wasted time when assembling the system.

To remedy these disadvantages, supports have been designed which consist of hollow tubes with polygonal cross-sections and with horizontal bores at regular intervals in which are inserted the means for hanging and holding the various accessories. These bores can, of course, be formed in one or in all the faces of the polygonal hollow tubes.

A further known form of support is made up of sections with part-conical tips provided with threaded portions. These threaded parts are screwed into threaded holes formed in part-conical openings which adjoin circular recesses in which are inserted the means for attaching the accessories. These supports have various disadvantages. For one thing, they are very expensive, due to the number of machining operations required, including machining the part-conical tips, threading, boring and threading, and machining the part-conical openings. The support is also rather unstable and is easily deformed, especially when the component parts are made of plastics materials. The connection between the tip and the opening is small in height, and the progressive threading of the part-conical tip involves a risk of breaking it. Should this happen, it is necessary to replace two sections, that in which the broken off tip is threaded, and that from which it broke off.

SUMMARY OF THE INVENTION

The aim of the present invention is to overcome these disadvantages, and the invention is intended to provide a shelving framework system with which tall furniture units and stop fittings can be constructed without tilting, in spite of the attachment of shelves and clips from which are hung various items for sale.

To this end, the invention consists in a shelving framework system for making up shelving units, desks and display units for fitting out shops, stores and the like, characterised in that it comprises sleeves of any suitable cross-section and preferably of a plastics material, which can be partially telescoped into one another and have means for limiting such inter-penetration so as to form gaps for receiving means for attaching accessories, the sleeves having metal reinforcing cores.

BRIEF DESCRIPTION OF THE DRAWINGS

The invention will be better understood by referring to the following description, given by way of non-limiting example, and to the accompanying drawing, in which:

FIG. 1 is a side view of a framework system in accordance with the invention;

FIG. 2 is a sectioned side view of a sleeve for making up the system shown in FIG. 1.

DESCRIPTION OF THE PREFERRED EMBODIMENT

To facilitate the understanding of the invention, reference will first be made to FIG. 2, which shows the basic elements required to make up the framework system in accordance with the invention.

The most important element is a sleeve 1, preferably made of a plastics material and consisting of an outer first hollow member 2 and an inner second hollow member 3. The latter is coaxially arranged with respect to the outer first hollow member 2, and the cross-sections of the members 2 and 3 are of any suitable but identical form allowing part of the one to fit inside the other, as shown. The two hollow members 2 and 3 are rigidly connnected together by gussets 4 and 5. Upper and lower rims 6 and 7 of the gussets 4 and 5 lie between upper and lower rims 8 and 9 of the first hollow member 2. The lower rim 7 of the gussets 4 and 5 is level with lower rim 10 of the inner second hollow member 3.

The inner member 3, as shown, is longer than the outer one, and has a hollow body 11 joined end-to-end with a reduced diameter section 13 by means of a shoulder 12. The lesser diameter portion 13 extends a pre-determined distance beyond the upper rim 8 of the first hollow member 2, the determination of this distance being explained below. The hollow body 11 defines a space 14, connected by a frusto-conical space 15 to a bore 16 in the reduced diameter section 13. The diameter of the space 14 is slightly greater than the diameter of the portion 13.

Because of this, the portion 13 can penetrate into the space 14' of an overlying and otherwise identical sleeve 1', in the desired orientation on the rim 8. Such penetration being limited by the upper frusto-conical section 15' against which abuts the upper rim 17 of the reduced diameter section 13 of the lower sleeve 1. In this way a gap 18 is formed between the lower rim 9' of the outer hollow member 2' of the upper sleeve 1' and the upper rim 8 of the outer hollow member 2 of the lower sleeve 1. The function of this gap will be described below. The reduced diameter section 13 incorporates a reinforcing core 19, preferably of matal.

The gap 18 enables attachement means for accessories, for example, as shown, for a shelf 20 to be fitted to the interconnected sleeves 1 and 1'. These attachment means consist of clips 21 each having two flanges 22 and 23 separated by a groove 24 in which the upper part of the outer first hollow member 2 locates, its upper rim 8 abutting the closed end of bottom 25 of the groove 24. The depth of the groove 24 is such that the lower rim 26 of the flange 23 does not contact the upper rim 6 of the gussets 4 and 5 which interconnect the two hollow members 2 and 3. The overall height of the flange 23 is slightly less than that of the gap 18, this allows the clip 21 to be fitted, to be removed to and from sleeve 1, after as well as before its interconnection with sleeve 1' (FIG. 2). Advantageously, a threaded hole 27 is formed in the flange 22, opening into the groove 24. Into the threaded hole 27 is screwed one end 28 of a stud 29 whose other end 30 is screwed into a threaded hole 31 in the end 32 of a bracket 33. The bracket 33 is for supporting shelves 20 or other accessories for presenting various articles.

In a first embodiment, the space 14 and the upper part of the reduced diameter portion 13 are cylindrical. In another embodiment (not shown) the space 14 may be slightly coned, flaring outwardly towards the lower rim 9. At the same time the reduced diameter portion 13 may have an identical taper, narrowing towards the upper rim 17. By the double cone arrangement, adjacent sleeves are coaxially aligned, and a tight assembly is obtained, giving a more rigid structure.

Reference will now be made to FIG. 1. FIG. 1 shows a frame 34 made up of two columns $35_1$ and $35_2$ consisting of sleeves 1, $1_1$, $1_2$ fitted together as shown in FIG. 1, the number of sleeves depending on the height of the frame. The two columns $35_1$ and $35_2$ have bases $37_1$ and $37_2$ at their respective lower ends $36_1$ and $36_2$ and are connected together by the bracket 33. The length and number of brackets used depend on the frame to be constructed.

Although the invention has been described with reference to a specific embodiment, it will be understood that it is in no way limited to that embodiment, and that it may be variously modified as to its form, the materials used and the combination of the various elements without departing from the scope or spirit of the invention.

I claim:

1. A support system for shelving and the like, comprising;

a plurality of sleeves, each having an outer, hollow sleeve member and, coaxially, rigidly interconnected therewith in an inner portion thereof, an hollow sleeve member longer than the outer member, the inner members being shaped and disposed for being longitudinally telescoped with one another to fit the sleeves together while leaving gaps between the respective outer members; and a plurality of clips, each dimensioned and shaped to permit removably attaching it to one of the outer members in one of the gaps, for supporting accessories such as shelves on the clips and thereby on the sleeves fitted together by the telescoped inner members.

2. A system according to claim 1 in which the inner and outer sleeve members have gussets, radial thereof and rigid therewith, for their interconnecting.

3. A system according to claim 1 wherein each inner sleeve member has a first, relatively wide, hollow end portion within the respective outer sleeve member, and a second, thinner end portion extending from the outer member and disposed for the telescoping with another inner member.

4. A system according to claim 3 wherein the first, relatively wide, hollow end portion defines an innermost space wider than the outside of the thinner end portion, and a frusto-conical space at the top of the innermost space, tapering to a width smaller than said outside, to assure coaxial fitting together of the sleeves by the telescoping of the inner members.

5. A system according to claim 1 wherein each clip is shaped and dimensioned to enable it to be inserted, transversally of the sleeves, in one of the gaps without contacting the outer members, and then to be moved longitudinally of the sleeves for its attaching to one of the outer members.

6. A system according to claim 2, wherein each clip has inner and outer flanges, separated by a groove for lodging therein an upper rim of an outer member, the clip being dimensioned so that the inner flange is spaced from the gussets of the respective sleeve.

7. A system according to claim 6, wherein each outer flange has a threaded hole opening into the groove, a stud screwed into the hole, and a bracket supported on an end of the stud, for supporting one of the accessories.

* * * * *